US005794109A

United States Patent [19]

Ota et al.

[11] Patent Number: 5,794,109

[45] Date of Patent: Aug. 11, 1998

[54] DEVELOPING APPARATUS HAVING RECESSED SECTIONS ON DEVELOPING ROLLER

[75] Inventors: Toshihiro Ota, Nara; Shigeyuki Wakada, Yamatokoriyama; Keiji Katoh, Nara; Eiichi Kido, Yamatokoriyama; Yuhi Yui, Nabari, all of Japan

[73] Assignee: Sharp Kabushiki Kaisha, Osaka, Japan

[21] Appl. No.: 630,601

[22] Filed: Apr. 11, 1996

[30] Foreign Application Priority Data

Apr. 12, 1995 [JP] Japan ..... 7-086590

[51] Int. Cl.[6] ..... G03G 15/08

[52] U.S. Cl. ..... 399/286; 399/279; 399/284

[58] Field of Search ..... 355/245, 246, 355/259; 399/119, 222, 252, 265, 279, 281, 286

[56] References Cited

U.S. PATENT DOCUMENTS 4,866,480 9/1989 Hosoya et al. ..... 355/245

5,076,201 12/1991 Nishio et al. ..... 399/284 X 5,097,294 3/1992 Nishio et al. ..... 399/284

FOREIGN PATENT DOCUMENTS 55-113070 9/1980 Japan .

6-48521 12/1994 Japan .

*Primary Examiner*—Arthur T. Grimley

*Assistant Examiner*—Quana Grainger

[57] ABSTRACT

A developing apparatus which is equipped with a developer control member for controlling the developer on a developer supporter to a prescribed thickness, and which uses a one-component developer, characterized in that recessed sections are formed at the surface of the developer supporter to receive the developer, and the density $\alpha$ of particles of the developer which enter the recessed sections and the nip width L1 between the developer control member and the developer supporter satisfy the relationship: $3<\alpha \cdot L1<10$.

17 Claims, 6 Drawing Sheets

DEVELOPING APPARATUS HAVING RECESSED SECTIONS ON DEVELOPING ROLLER

BACKGROUND OF THE INVENTION

1. Field of the Invention

The present invention relates to a non-magnetic, one-component developing apparatus for use in electrophotography-based image formation mechanisms such as laser printers, copying machines, laser facsimile machines, etc.

2. Description of the Background Art

Japanese Unexamined Patent Application Disclosure SHO 55-113070 discloses formation of a toner layer with a uniform thickness for a developing apparatus by forming the surface layer of a developer supporter with an elastic material to provide a surface roughness of 6S or more to prevent slippage between the developer supporter and the toner layer.

In addition, Japanese Examined Utility Model Law Application Publication HEI 6-48521 discloses a non-magnetic, one-component developing apparatus designed for constant supply of toner in such a manner that a charge control member made of an elastic material is brought into contact with a developer supporter which supplies toner to an electrostatic latent image supporter, to provide the toner with a prescribed charge by the charge control member, and the toner is deposited on the electrostatic latent image supporter to render the electrostatic latent image visible, while the entire surface of the developer supporter is worked into a rough surface with a prescribed uniform roughness Rz (a ten-point average roughness as specified by JIS) in a direction at right angles to the direction of toner carrying, thereby establishing an axially uniform charge on the developer supporter. This is means for increasing the layer thickness of the developer to a uniform thickness, and developer apparatuses based on such means are commonly used.

It is conventional to prevent creation of a memory or fogging by cleaning which includes scraping developer that has not been consumed during development, off the surface of the developer supporter with a sponge roller or blade, etc. after passing through the photoconductor.

The provision of a scraping member as mentioned above results in a load on the developer supporter, and thus a high driving torque becomes necessary for its rotation. This requires the use of an expensive motor and driving power supply, and also leads to higher power consumption.

With developing apparatuses employing a one-component development method, since there is no need to scrape the unused developer off the surface of the developer supporter, a scraping member is not needed, but this in turn increases the probability of repeated rotation of the same toner (a one-component developer) adhering to the developer supporter in the absence of a scraping member. Therefore, the charge of the toner increases accordingly, and this increased charge (image force) of the toner causes the toner to further resist leaving the surface of the developer supporter due to the presence of the control member which regulates the toner layer to a uniform thickness, and additional supply of toner results in a larger toner layer thickness. This may result in the problem of fogging due to increase in the potential of the outermost layer of the toner on the developer supporter over the potential of the photoconductor.

In addition, with the developer apparatus described in the above-indicated reference, since the surface of the developer supporter is worked into a rough surface without considering the radius of particles of the toner, there is the risk of insufficient charging depending on the radius of particles of the toner, or unstable adhesion of the toner, and this leads to a nonuniform layer thickness (amount of adhesion). Further, since the mechanical capacity of carrying the toner increases, the thickness of the toner layer increases with the formation of fogging. Use of the control member made of an elastic material and a larger nip with the developer supporter also ensure uniform, thinner toner layer on the surface of the developer supporter, and prevention of fogging due to supercharging. However, the use of an elastic material as the control member necessitates mounting of the control member with higher precision, and this in turn requires many parts, thus increasing the manufacturing cost.

SUMMARY OF THE INVENTION

In consideration of the above-mentioned problems, the present invention provides a developing apparatus which suppresses the charge of the toner layer on the surface of a developing supporter while controlling the layer to a uniform, smaller thickness.

The means used to solve the problems, according to the present invention, involves formation of recessed sections on the surface of a developer supporter which receives the developer, and establishment of the relationship: $3<\alpha \cdot L1<10$, wherein $\alpha$ is the density of particles of the developer having entered the recessed sections, and L1 is the nip width between the developer control member and the developer supporter. The means used to solve the problems also satisfies both the relationships: $r/4<L2<2r$, and $r/4<L3<2r$, wherein L2 is the depth of each recessed section, L3 is the width of each recessed section, and r is the radius of each particle of the developer, in addition to the above-mentioned relationship.

Also, according to the present invention, the amount of adhesion (layer thickness) of developer on the developer supporter is controlled to 1.0 $mg/cm^2$ or less, the recessed sections open toward the upstream direction of flow of the developer, and further the developer Is applied to the surface of the developer supporter in advance.

BRIEF DESCRIPTION OF THE DRAWINGS

Other and further objects, features, and advantages of the invention will be more explicit from the following detailed description taken with reference to the drawings wherein.

DETAILED DESCRIPTION OF THE INVENTION

Figure 1A:
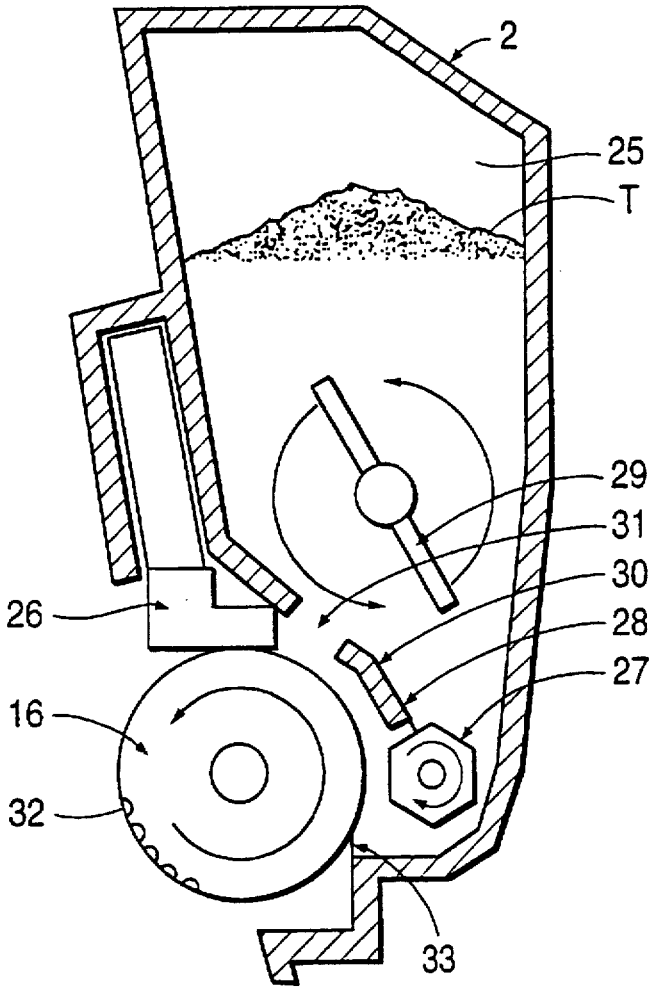
FIGS. 1A and 1B are views illustrative of a developer apparatus according to the present invention, wherein 1A is a schematic diagram thereof, and 1B is an enlarged view of the main portion of the developing roller.

Now referring to the drawings, preferred embodiments of the invention are described below.

Figure 2:
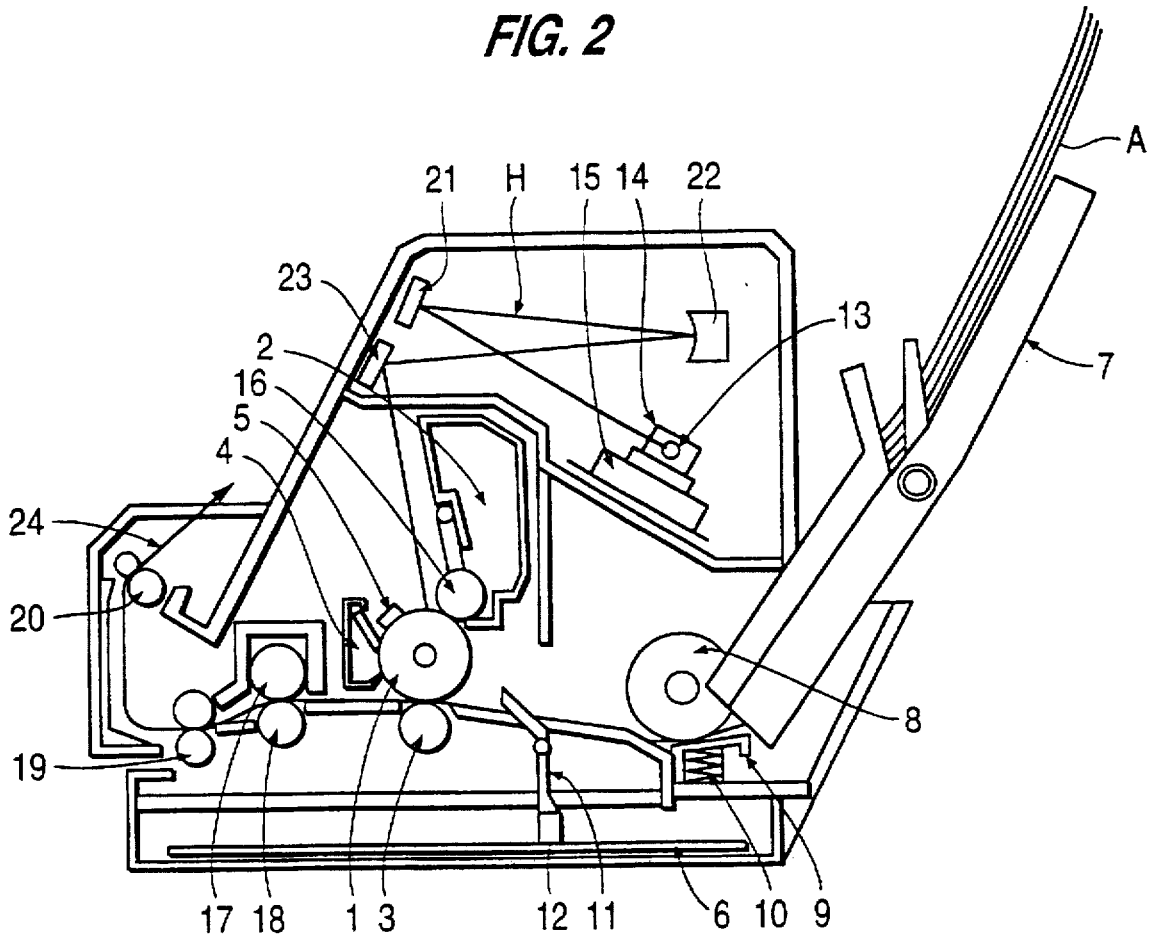
FIG. 2 is a rough schematic diagram of a laser printer with a developing apparatus according to the present invention.
Figure 3:
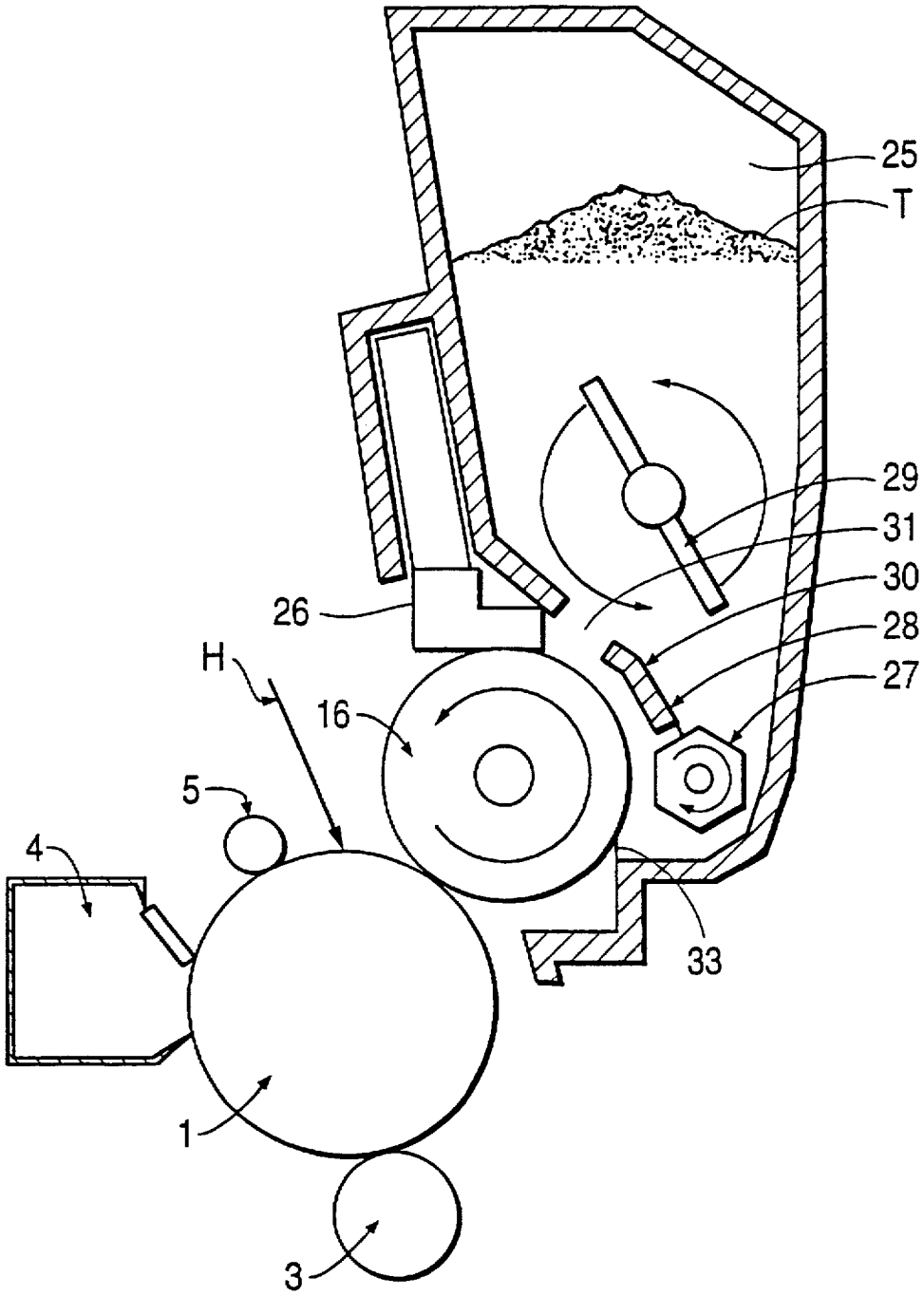
FIG. 3 is a view illustrative of a developing process.

The overall configuration of a laser printer with a developing apparatus according to the present invention is shown in FIGS. 2 and 3. In the drawings, 1 is a photoconductor used as the electrostatic latent image supporter, 2 is a developing apparatus which supplies a developer to the photoconductor 1, 3 is a transfer roller, 4 is a cleaning unit, and 5 is a charging member, all placed around the photoconductor 1. Reference number 6 represents a control section which receives a variety of information to supervise the developing process.

Paper A is stacked on a paper feed tray 7, and fed to the inside of the printer sheet by sheet, by the action of a paper feed roller 8, a sheet-separating friction plate 9, and a press spring 10. The fed paper A folds a paper-sensing actuator 11 forward to cause an optical paper sensor 12 to output an electric signal so that the control section 6 gives instructions to begin image printing. The control section 6 activated by the operation of the paper-sensing actuator 11 sends an image signal to a laser diode light emitting unit 13 to control ON/OFF switching of the light emitting diodes. A scanning mirror 14 is rotated at a high constant speed by a scanning mirror motor 15, scans laser light H in a direction perpendicular to the plane of the drawing, performs selective exposure of the surface of the photoconductor 1 by the use of a first reflecting mirror 21, a second reflecting mirror 22 and a third reflecting mirror 23 based on the ON/OFF information from the control section 6, and selectively discharges the surface charge of the photoconductor 1 previously charged by the charging member 5 to form an electrostatic latent image.

The toner available for development is accumulated in the developing apparatus 2, and the toner charged by appropriate agitation adheres to the surface of the developing roller 16 which serves as the developer supporter, and a toner image matching the electrostatic latent image may be formed on the photoconductor 1 by the action of electric fields created by the development-bias voltage applied to the developing roller 16, and the surface voltage of the photoconductor 1. The paper A receives toner thereon which is transferred from the photoconductor 1 due to electric attraction by the action of the electric field provided by the transfer voltage applied to the transfer roller 3 while being fed between the photoconductor 1 and the transfer roller 3.

The paper A is then given an appropriate temperature and pressing force from a fixing roller 17 and a press roller 18 kept at 140° C., and as a result, the toner is melted and fixed on the paper A to form a fast image. The paper A is then fed by paper feed rollers 19 and 20 for ejection outside the machine. The untransferred toner on the photoconductor 1 is recovered by the cleaning unit 4.

Here, the developing apparatus 2 is based on non-magnetic, one-component development, and the one-component toner developer is a dispersion of a pigment such as carbon in a plastic resin selected from a variety of types, including styrene resins and acryl resins, sized to 5–20 μm by crushing and sieving.

Figure 1B:
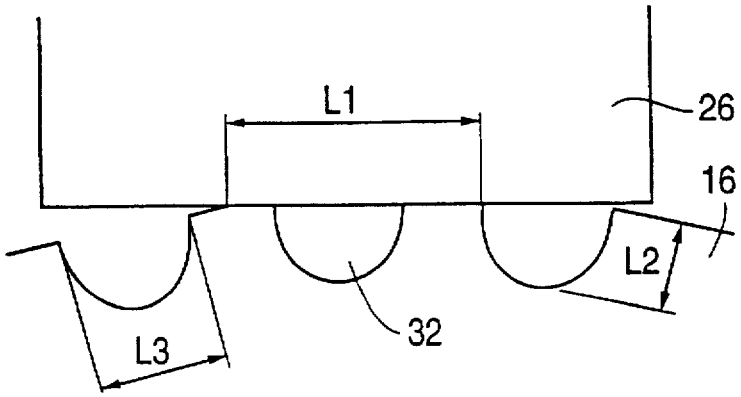

As shown in FIG. 1, placed in a developer tank 25 are the developing roller 16, a toner control member 26 which is the developer control member for regulating the thickness of the toner layer by establishing a uniform amount of adhesion (hereunder referred to as layer thickness), a polygonal-section roller 27 which supplies the toner to the developing roller 16, a scraping plate 28 for scraping the toner on the polygonal-section roller 27, and an agitator 29. A wall 30 is provided between the developing roller 16 and the agitator 29 to form a plurality of opening sections 31.

The developing roller 16, which serves to carry the toner to the developing area of the photoconductor 1, is placed at the mouth of the developer tank 25 which is formed facing the photoconductor 1, is constructed of an elastic material with an outer diameter ϕ of 16 mm, is pressed against the photoconductor 1 to a given nip width (0.3 mm) with the photoconductor 1, with the shaft of the roller supported by the developer tank 25 in a freely rotatable manner, and is rotated at a peripheral speed of 32.5 mm/sec with a motor, gear or the like in the direction indicated by the arrow in the drawing. The elastic material may be any conductive elastic material such as urethane rubber, silicone rubber or NBR rubber, with an Askar C hardness of 50°–90°, and an electric ohm value preferably of $10^4$–$10^8$ Ω, and most preferably $10^6$–$10^7$ Ω.

As shown in FIG. 1, the surface of the developing roller 16 has holes 32 formed as the recessed sections for receiving toner. The holes 32 are hemispherical recesses on the surface of the developing roller 16, which are arranged along the entire periphery in its axial direction. Here, the surface of the developing roller 16, except for the holes 32, desirably has a Rz (ten-point average roughness as specified by JIS) of 5 μm or less in order to prevent filming of the developing roller (increase in the toner layer thickness) with time and to maintain the uniformity of the layer.

The toner control member 26 is placed near the opening section 31, upstream of the flow of the toner from the developing area of the developing roller 16 which is brought into contact with the photoconductor 1, and is attached to the developer tank 25 so as to press against the developing roller 16 with a biasing member such as a spring. The surface of the toner control member 26 which faces the developing roller 16 is flat along its entire axis, and is formed of rigid stainless steel, aluminum or some other alloy, with the radius of the upstream edge being 25 μm or less, and this design does not prevent the flow of the toner carried by the developing roller 16, thus facilitating the flow of the toner which has left the developing roller 16 for the opening section 31.

Here, the toner control member 26 is pressed against the developing roller 16 at a pressure of 30 g/cm$^2$, and if the pressure is lower than this value, the member 26 cannot control the toner, and the toner is freed from and leaves the toner control member 26. On the other hand, in cases where the pressure is higher than that value, the toner tends to fuse to the toner control member 26. Accordingly, as a general rule, favorable effects are produced when the pressure is 15–45 g/cm$^2$, and most preferably the pressure is 25–35 g/cm$^2$.

The polygonal-section roller 27, which has a hexagonal-section with a diagonal line length of 12 mm, is placed in the spacing between the front-end of the wall 30 and the wall of the developer tank 25, upstream from the toner control member 26 in the direction of the flow of the toner. This polygonal-section roller 27 is rotated by a motor or the like at a peripheral speed of 40 mm/sec in the direction indicated by the arrow in the drawing. The scraping plate 28 is a thin plate attached to the front-end of the wall 30 toward the polygonal-section roller 27, which is designed to be bent when caught on the corners of the polygonal-section roller 27 rotating in contact with the plate 28. Here, the polygonal-section roller 27 carries less toner as the number of the corners increases, and more as it decreases. However, the amount of toner carried becomes uneven when there are too few corners; preferably, the polygonal-section roller 27 has 5–8 corners.

The agitator 29, placed over the polygonal-section roller 27, but near the opening section 31, is rotated by a motor or the like to agitate and carry the toner from the opening section 31 toward the polygonal-section roller 27. The developing roller 16, the polygonal-section roller 27 and the agitator 29 are driven to rotate in synchronism with one another, with separate motors, or the same motor. In the drawing, 33 is a catch plate for preventing the toner from escaping from the developer tank 25.

With the configuration mentioned above, the toner contained in the developer tank 25 is carried as the polygonal-section roller 27 rotates, scraped by the scraping plate 28, and forced into the area confined by the developing roller 16, the polygonal-section roller 27, the toner control member 26 and the wall 30. This increases the pressure imposed on the toner, and the toner charged due to friction with the developing roller 16 adheres to the developing roller 16 to a given thickness, and then enters the holes 32 at the surface.

The toner adhering to a given thickness is then controlled to a smaller layer thickness by the toner control member 26, thus ensuring a uniform layer thickness. Excess toner is separated and returned to the agitator 29 through the opening section 31. The toner with a given layer thickness which adheres to the developing roller 16 is carried to the developing area where it is brought into contact with the photoconductor 1 for development.

Figure 4:
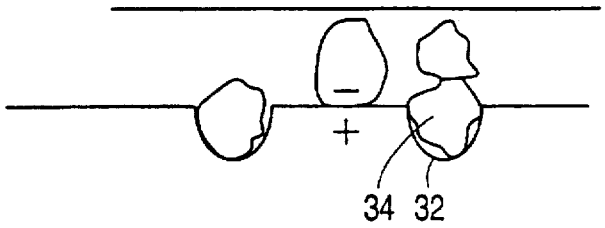
FIG. 4 is a view illustrative of the state of toner on the developing roller.

Here, since the toner enters the holes 32 formed in the surface of the developing roller 16, the toner 34 which has entered and been fixed in the holes 32 is rubbed against the unfixed ordinary toner as shown in FIG. 4 to lower the degree of charging of the toner, and this facilitates separation of the toner from the developing roller 16, and thus control of the layer thickness by the toner control member 26 is facilitated as well. Also, since contact between the toner and the developing roller 16 is minimized, the coefficient of friction-of the developing roller 16 decreases, and the developing roller 16 has a lower surface roughness, the toner-carrying capacity is lowered. As a result, increase in the layer thickness is suppressed to prevent the occurrence of fogging.

Figure 5:
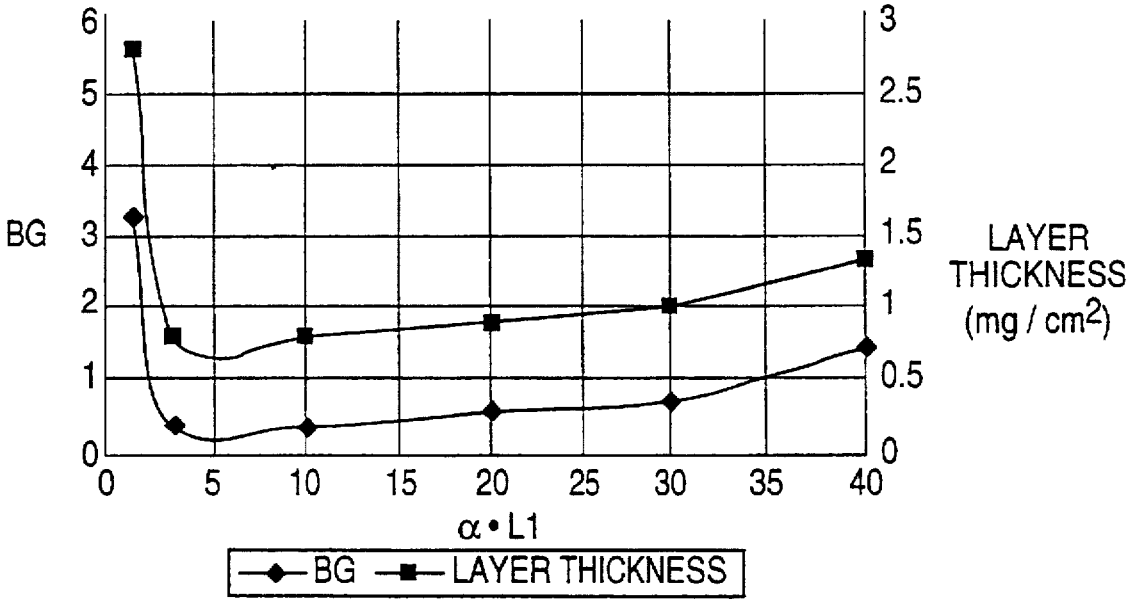
FIG. 5 is a view illustrative of the effect of the number of particles of the toner which have entered the recessed portions on the prevention of fogging and the layer thickness.

It is to be noted here that the number of particles of the toner which have entered the holes 32 of the developing roller 16 influences the occurrence of fogging and the layer thickness. When the density of particles of the toner which have entered the holes 32 is represented by $\alpha$ (may be expressed in terms of $mm^{-1}$ and described as representing the number of toner particles aligned along the nip width), and the nip width (may be expressed in terms of mm) between the toner control member 26 and the developing roller 16 is represented by L1, their relationship with fogging may be expressed as illustrated in FIG. 5. More specifically, when $\alpha \cdot L1$ is smaller than 3, the area of contact between the toner and the developing roller 16 increases, thus enlarging the layer thickness, increasing the background concentration (BG) and consequently increasing the frequency of fogging. On the other hand, when $\alpha \cdot L1$ is over 10, the contact between the toner and the developing roller 16 is minimized to reduce the charge of the toner, and as the layer thickness increases, the background concentration tends to increase, and the frequency of fogging tends to increase as well. Accordingly, the nip width may be set so as to satisfy the relationship: $3<\alpha \cdot L1<10$ in order to prevent the occurrence of fogging.

The size of the holes 32 has an effect on fogging as well. When the depth L2 of the holes 32 increases, the pressing of the surface when the developing roller 16 passes the toner control member 26 stretches the holes 32, and this produces the same effect as increasing the surface roughness. Therefore, the toner-carrying capacity increases, which results in the increased amount of adhesion of toner, and thus fogging tends to occur. On the other hand, in cases where the holes 32 have a small depth L2, the toner in the holes 32 is hardly fixed, and thus the amount of adhesion of toner increases, which leads to fogging.

Figure 6:
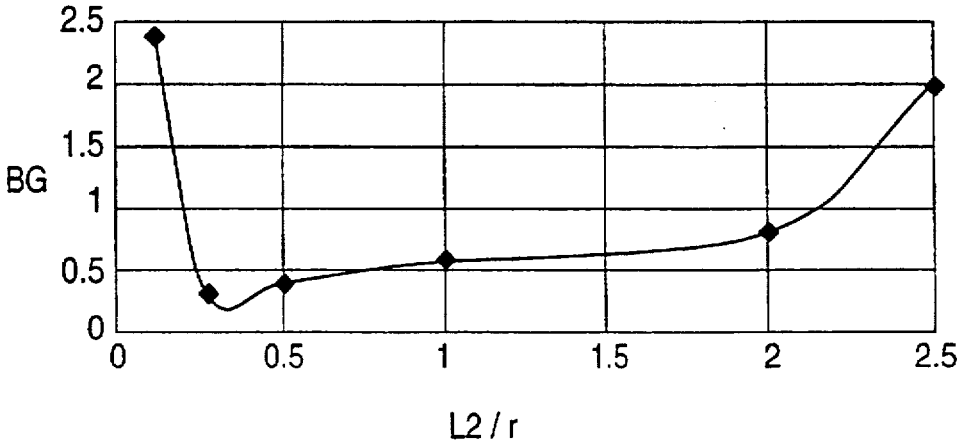
FIG. 6 is a view illustrative of the relationship between the fogging and the depth of the recessed portions.
Figure 7:
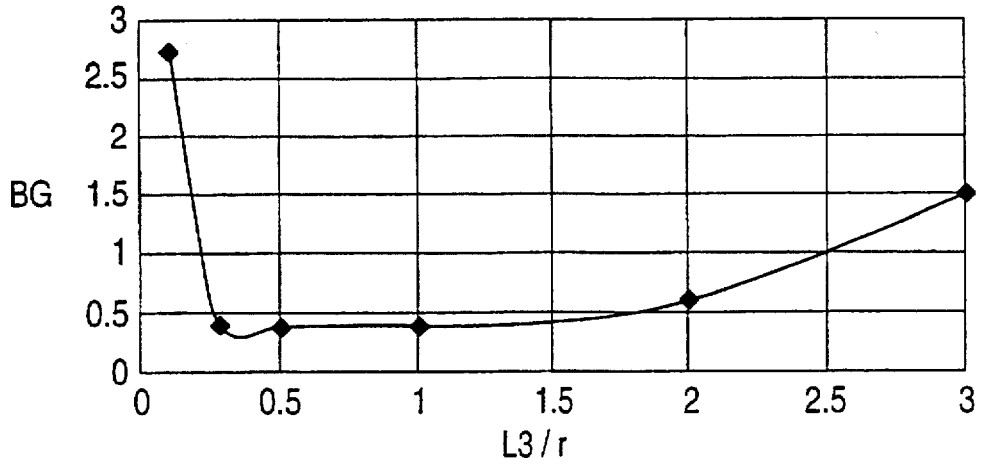
FIG. 7 is a view illustrative of the relationship between the fogging and the width of the recessed portions.

The size of the holes 32 and the radius r of the toner must be related with each other in order to prevent fogging, and the fogging may be prevented as long as they satisfy the relationship: $r/4<L2<2r$, as shown in FIG. 6. In contrast, the width L3 of the holes 32 which satisfies the relationship: $r/4<L3<2r$, produces good effects against fogging, as shown in FIG. 7. More specifically, the toner cannot enter the holes 32 when their width is smaller, whereas toner which has entered the holes 32 cannot be fixed when the width is larger, for the same reason as discussed for the depth of the holes 32.

Figure 8:
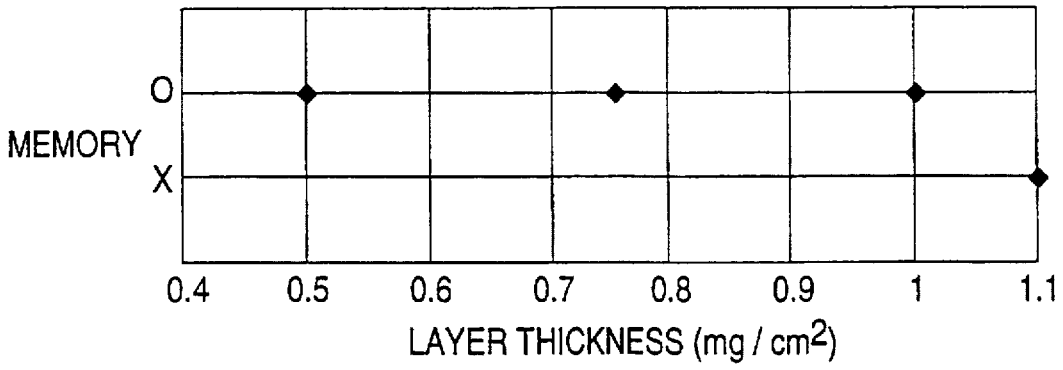
FIG. 8 is a view illustrative of the effect of the layer thickness on the prevention of creation of a memory.

In addition, although the toner layer thickness is controlled by the toner control member 26, the probability of contact between the fixed toner 34 which has entered the holes 32 shown in FIG. 4 and the ordinary toner decreases as the layer thickness increases, and a memory may be created as a result of increase of the charge. Therefore, in cases where the toner layer thickness is set to be 1.0 $mg/cm^2$ or less, as shown in FIG. 8, the probability of contact between the fixed toner 34 and the ordinary toner increases to prevent creation of a memory. This is because the contact between the fixed toner 34 and the ordinary toner causes the fixed toner 34 to be charged by the ordinary toner to lower the degree of charging thereof in cases where the degree of charging of the ordinary toner is higher, and conversely, the ordinary toner is charged by the fixed toner 34 when the former is less charged, and thus the charge of the toner is made uniform to lower the background concentration, as shown in FIG. 5, thus preventing fogging.

As indicated above, the formation of the holes 32 with a specific shape on the surface of the developer roller 16 allows minimization of the charge of the toner, facilitates establishment of a uniform, thinner toner layer on the surface of the developer roller 16, and thus prevents fogging and creation of a memory to produce high-quality images. In addition, the toner control member 26 is rigid, and this results in a lower parts count than in the case where an elastic material is used instead. In addition, since the charge of the toner is stably minimized, the layer thickness does not increase even without a scraping section for removing the untransferred toner on the developer roller, and this means that the manufacturing cost may be reduced, and further the power consumption may be reduced as well, since there is no need to use a motor, a power supply for the motor, etc., for the scraping section.

In addition, since the recessed sections open toward the upstream direction of the flow of the developer, the developer supporter 16 tends not to collect dirt, etc. Therefore, the chance of the developer supporter 16 carrying dirt to the developer control member 26 is minimized, and this also helps to prevent removal of the developer from the surface of the developer supporter 16 by dirt, etc. caught on the developer control member 26.

Figure 9:
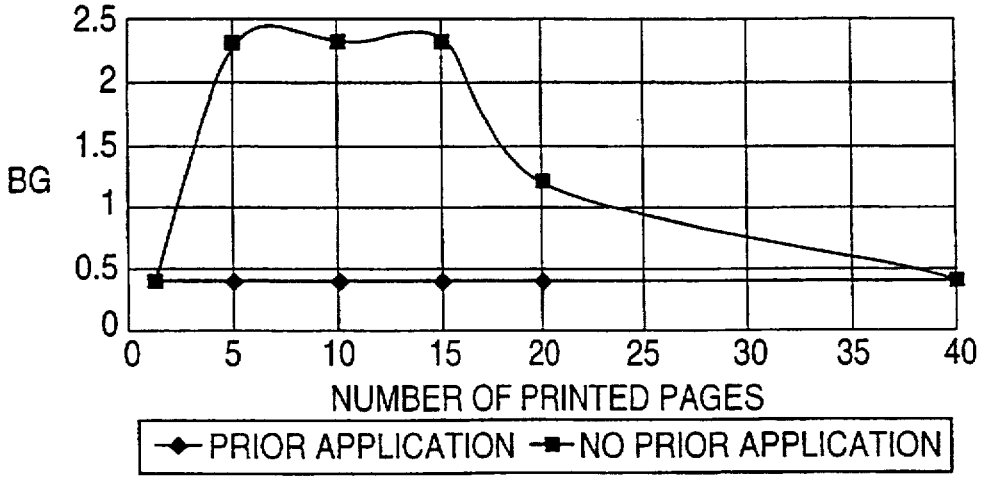
FIG. 9 is a view illustrative of the effect of the prior application on the prevention of fogging.

Here, since the operational effect described above is ascribable to toner entering into the holes 32 of the developer roller 16, it is advisable to apply toner to the developer roller 16 prior to its installation in the developing apparatus. This is because, as shown in FIG. 9 which shows the relationship between the presence or absence of prior application of toner and occurrence of fogging, it is understood that prior application of toner is useful to prevent fogging in the early stages of printing the first few pages. This is because it takes time for the toner to enter and be fixed in the holes 32 in the absence of prior application of toner, during which time fogging may occur, whereas the toner fixed in the holes 32 by prior application produces the effect of the fixed toner 34 from the start of printing.

Figure 10:
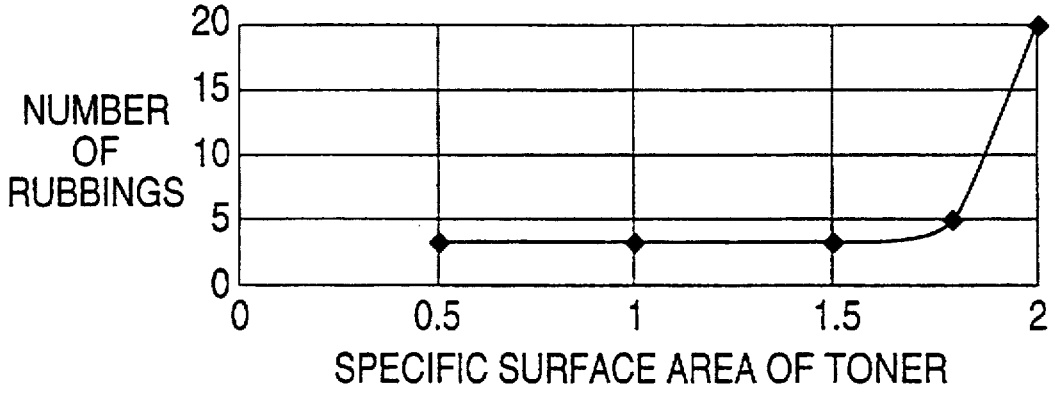
FIG. 10 is a view illustrative of the relationship between the number of rubbings and the specific surface of the toner.

In the method of prior application of toner, toner applied to a dried cloth or the like is rubbed five times over the entire periphery of the developing roller 16 in the direction of its axis. Here, the number of rubbings required to prevent fogging is understood to be reduced by setting the specific surface area S of the toner so as to satisfy $S<1.8$, as shown in FIG. 10. More specifically, toner which has merely been crushed cannot easily enter the holes 32, and thus more rubbing is required, whereas the toner enters more easily into the holes 32 when it is made spherical, and this also results in a reduced time for the assembly of the developing apparatus and a reduced manufacturing cost.

Figure 11:
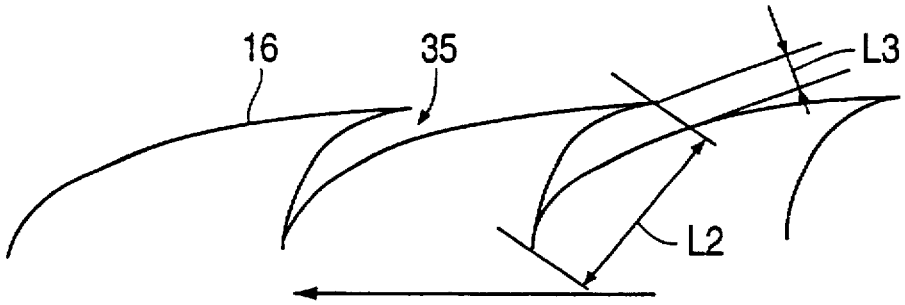
FIG. 11 is a view illustrative of recessed portions of the developing roller according to another embodiment of the present invention.

It is understood, of course that the present invention is not restricted to the embodiment described above, and many modifications and alterations may be made to the embodiment within the scope of the present invention. For example, in cases where a scraping section for removing untransferred toner on the developing roller 16 is not provided as according to the embodiment, since paper crumbs and other dirt are not removed by a scraping section, this dirt, etc. takes the place of the toner and is caught on the toner control member 26, causing white streaks to appear across the characters or graphics on the developed paper. Therefore, in order to prevent this, as shown in FIG. 11, a plurality of fine splits 35 are formed as the recessed sections of the developing roller 16 to provide scales opening toward the upstream direction of the flow of the toner. These are useful to avoid collecting dirt, etc., and thus to prevent occurrence of white streaks. Here, it is also necessary that the radius of the toner, and the depth and the width of the fine splits satisfy the relationship required according to the embodiment described above.

As is apparent from the foregoing explanation, the design of the recessed sections 32 formed at the surface of the developer supporter 16 according to the present invention such that the density $\alpha$ of particles of the developer, and the nip width L1 between the developer control member 26 and the developer supporter 16 satisfy the relationship: $3<\alpha \cdot L1<10$, allows the developer to properly enter and be fixed in the recessed sections 32. The friction between the fixed developer 34 and the ordinary developer then lowers the charging of the developer, and this facilitates separation of the developer from the developer supporter 16. In addition, since it is made more difficult for the developer to contact the developer supporter 16, the coefficient of friction of the developer supporter 16 is lowered to decrease its developer-carrying capacity. As a result, it is easier to establish a uniform, thinner layer of developer on the developer supporter 16 by the developer control member 26, and thus to produce fog-free high-quality images.

In addition, since it is easy to separate the developer from the developer supporter 16, the developer supporter 26 may be made of a rigid material, and this results in a lower parts count than in the case where an elastic material is used instead. In addition, since the charge of the developer is stably minimized, the layer thickness does not increase even without a scraping section for removing the untransferred toner on the developer supporter 16, and this means that the manufacturing cost may be reduced, and further the power consumption may be reduced as well, since there is no need to use a motor, a power supply for the motor, etc., for the scraping section.

The setting of the depth L2 and the width L3 of the recessed sections 32 and the radius r of the developer so as to satisfy the relationships: $r/4<L2<2r$, and $r/4<L3<2r$ according to the present invention, results in an advantageous relationship between the sizes of the recessed sections 32 and the developer which helps to prevent fogging.

The setting of the amount of adhesion of the developer to 1.0 $mg/cm^2$ or less according to the present invention results in an increased probability of contact between the developer 34 which has entered and been fixed in the recessed sections 32 and the unfixed developer, and thus lowering the charge which helps to prevent fogging and creation of a memory.

Since the recessed sections 32 open toward the upstream direction of the flow of the developer according to the present invention, less dirt, etc. is carried by the developer supporter 16 and caught on the developer control member 26, and this avoids the inconvenience of the developer being removed from the surface of the developer supporter 16 and causing white streaks to appear across the characters or graphics on the developed paper.

Prior application of a developer to the surface of the developer supporter 16 according to the present invention to fix the developer in the recessed sections in advance serves to prevent fogging from the start of printing, unlike in cases where the developer is not previously applied, and thus cannot prevent fogging until the developer enters and is fixed in the recessed sections.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing apparatus which is equipped with a developer control member for controlling a developer on a developer supporter to a prescribed thickness, and which uses a one-component developer, the developing apparatus comprising:

recessed sections, formed on a surface of the developer supporter, for receiving the developer, wherein the following relationship is satisfied:

$$3<\alpha \cdot L1<10$$

wherein "$\alpha$" represents a density of particles of the developer which enter the recessed sections and "L1" represents a nip width between the developer control member and the developer supporter.

2. The developing apparatus according to claim 1, wherein the following relationships are further satisfied:

$$r/4<L2<2r \text{ and } r/4<L3<2r$$

wherein "r" represents a radius of each particle of the developer, "L2" represents a depth of each recessed section, and "L3" represents a width of each recessed section.

3. The developing apparatus according to claim 1, wherein an amount of adhesion of developer on the developer supporter is controlled to 1.0 $mg/cm^2$ or less.

4. The developing apparatus according to claim 1, wherein the recessed sections open toward an upstream direction of flow of the developer.

5. The developing apparatus according to claim 1, wherein the developer is applied to the surface of the developer supporter in advance.

6. A developing apparatus comprising:

a developer supporter having a surface for supporting a developer, the surface having recessed portions; and a developer control member, mounted adjacent said developer supporter, for controlling the developer on the surface of said developer supporter to be a predetermined thickness, a density of particles $\alpha$ of the developer and a nip width L1 between said developer supporter and said developer control member being related such that $3<(\alpha)(L1)<10$.

7. The developing apparatus of claim 6, wherein a radius r of the recessed sections, a depth L2 of the recessed sections and a width L3 of the recessed sections are related such that $r/4<L2<2r$ and $r/4<L3<2r$.

8. The developing apparatus of claim 6, wherein an amount of adhesion of the developer on said developer supporter is controlled 1.0 $mg/cm^2$ or less.

9. The developing apparatus of claim 6, wherein the recessed sections open toward an upstream direction of flow of the developer onto said developer supporter.

10. The developing apparatus of claim 6, wherein the developer is preapplied to said developer supporter prior to operation of the developing apparatus.

11. A developing apparatus comprising:

a developer supporter having a surface for supporting a developer, the surface having recessed portions; and a developer control member, mounted adjacent said developer supporter, for controlling the developer on the surface of said developer supporter to be a predetermined thickness, a radius r of the recessed sections, a depth L2 of the recessed sections and a width L3 of the recessed sections being related such that $r/4<L2<2r$ and $r/4<L3<2r$.

12. The developing apparatus of claim 11, wherein a density of particles $\alpha$ of the developer and a nip width L1 between said developer supporter and said developer control member are related such that $3<(\alpha)(L1)<10$.

13. The developing apparatus of claim 11, wherein an amount of adhesion of the developer on said developer supporter is controlled to 1.0 $mg/cm^2$ or less.

14. The developing apparatus of claim 11, wherein the recessed sections open toward an upstream direction of flow of the developer onto said developer supporter.

15. The developing apparatus of claim 11, wherein the developer is preapplied to said developer supporter prior to operation of the developing apparatus.

16. A developing roller for transferring developer from a developer tank to a photoconductive drum comprising:

an outer peripheral surface; and a plurality of recessed sections formed in said outer peripheral surface, a radius r of the recessed sections, a depth L2 of the recessed sections and a width L3 of the recessed sections being related such that $r/4<L2<2r$ and $r/4<L3<2r$.

17. The developing roller of claim 16, wherein the recessed sections are opened toward an upstream direction of flow of the developer from the developer tank to the developing roller.

* * * * *